US011814706B2

(12) United States Patent
Shinoda

(10) Patent No.: US 11,814,706 B2
(45) Date of Patent: Nov. 14, 2023

(54) ALUMINUM ALLOY CONDUCTIVE WIRE, ELECTRICAL WIRE AND WIRE HARNESS USING THE SAME

(71) Applicant: FUJIKURA LTD., Tokyo (JP)

(72) Inventor: Tatsunori Shinoda, Chiba (JP)

(73) Assignee: Fujikura Ltd., Tokyo (JP)

( * ) Notice: Subject to any disclaimer, the term of this patent is extended or adjusted under 35 U.S.C. 154(b) by 1128 days.

(21) Appl. No.: 16/093,455

(22) PCT Filed: Jun. 16, 2017

(86) PCT No.: PCT/JP2017/022259
§ 371 (c)(1),
(2) Date: Oct. 12, 2018

(87) PCT Pub. No.: WO2017/221819
PCT Pub. Date: Dec. 28, 2017

(65) Prior Publication Data

US 2021/0079500 A1 Mar. 18, 2021

(30) Foreign Application Priority Data

Jun. 20, 2016 (JP) ..... 2016-121916

(51) Int. Cl.
*C22C 21/02* (2006.01)
*H01B 1/02* (2006.01)
(Continued)

(52) U.S. Cl.
CPC ..... *C22C 21/02* (2013.01); *H01B 1/023* (2013.01); *H01B 5/02* (2013.01); *H01B 7/0045* (2013.01)

(58) Field of Classification Search
None
See application file for complete search history.

(56) References Cited

U.S. PATENT DOCUMENTS

2015/0007910 A1* 1/2015 Sekiya ..... C22C 21/16 148/417
2016/0358685 A1* 12/2016 Yoshida ..... C22F 1/04

FOREIGN PATENT DOCUMENTS

EP 2597169 A1 5/2013
EP 2641985 A1 9/2013
(Continued)

OTHER PUBLICATIONS

Murray, G. T. et al., "Preparation and Characterization of Pure Metals", ASM Handbook vol. 2, pp. 1093-1097, ASM International. (Year: 1990).*

(Continued)

*Primary Examiner* — George Wyszomierski
*Assistant Examiner* — Janell C Morillo
(74) *Attorney, Agent, or Firm* — Osha Bergman Watanabe & Burton LLP

(57) ABSTRACT

An aluminum alloy conductive wire that includes 0.15 mass % or more and 0.25 mass % or less of Si; 0.6 mass % or more and 0.9 mass % or less of Fe; 0.05 mass % or more and 0.15 mass % or less of Cu; 0.2 mass % or more and 2.7 mass % or less of Mg, and 0.03 mass % or less in total of Ti, V, and B. The aluminum alloy conductive wire has tensile strength of equal to or less than $T_1$ MPa represented by $T_1$=59.5 ln(x)+231 and conductivity of equal to or more than C % IACS represented by $C=1.26x^2-11.6x+63.4$ in a case where a content rate of Mg in the aluminum alloy conductive wire is x mass %.

8 Claims, 3 Drawing Sheets

(51) Int. Cl.
*H01B 7/00* (2006.01)
*H01B 5/02* (2006.01)

(56) References Cited

FOREIGN PATENT DOCUMENTS

| | | | |
|---|---|---|---|
| JP | 2010-265509 | A | 11/2010 |
| JP | 2012-229485 | A | 11/2012 |
| JP | 2015-21156 | A | 2/2015 |

OTHER PUBLICATIONS

Supplementary European Search Report issued in corresponding European Patent Application No. 17815287.2, dated Jan. 10, 2020 (6 pages).

* cited by examiner

ALUMINUM ALLOY CONDUCTIVE WIRE, ELECTRICAL WIRE AND WIRE HARNESS USING THE SAME

TECHNICAL FIELD

The present invention relates to an aluminum alloy conductive wire, an electrical wire and a wire harness using the same.

BACKGROUND

In recent years, an electrical wire constituting a wire harness or the like used for an opening-closing portion such as a vehicle door, or a portion around a vehicle engine has been required to be lightweight and hence it has been studied to use an aluminum alloy conductive wire instead of a copper wire as the electrical wire.

For example, as such an aluminum alloy conductive wire, an aluminum alloy conductive wire disclosed in Patent Document 1 below is known. In Patent Document 1 below, disclosed is an aluminum alloy conductive wire which contains 0.03 to 1.5 mass % of Mg, 0.02 to 2.0 mass % of Si, 0.1 to 1.0 mass % of at least one element selected from Cu, Fe, Cr, Mn and Zr in total, and which has conductivity of 40% IACS or more, tensile strength of 150 MPa or more, elongation of 5% or more, wire diameter of 0.5 mm or less and a maximum crystal grain size of 50 μm or less.

CITATION LIST

Patent Document

Patent Document 1: JP 2012-229485 A

However, the aluminum alloy conductive wire described in the above-mentioned Patent Document 1 shows decrease in strength after a heat-resistance test, and has room for improvement in terms of heat resistance.

SUMMARY OF THE INVENTION

One or more embodiments provide an aluminum alloy conductive wire having excellent heat resistance, an electrical wire and a wire harness using the same.

The present inventors conducted intensive studies particularly focusing on the content rate of Mg in the aluminum alloy conductive wire. As a result, the present inventors found that the above-mentioned problems can be solved in a case where content rates of Si, Fe, Cu, and Mg are set to specific ranges in an aluminum alloy conductive wire, a total content rate of Ti, V, and B is set to be less than or equal to a specific value, and tensile strength is set to have a specific relation to a formula using a content rate of Mg and conductivity is set to have a specific relation to a formula using a content rate of Mg.

That is, one or more embodiments of the present invention are an aluminum alloy conductive wire which contains 0.15 mass % or more and 0.25 mass % or less of Si, 0.6 mass % or more and 0.9 mass % or less of Fe, 0.05 mass % or more and 0.15 mass % or less of Cu, 0.2 mass % or more and 2.7 mass % or less of Mg, and 0.03 mass % or less in total of Ti, V, and B, which has tensile strength of equal to or less than $T_1$ MPa represented by the following formula (1) and has conductivity of equal to or more than C % IACS represented by the following formula (2), in a case where a content rate of Mg in the aluminum alloy conductive wire is x mass %.

$$T_1=59.5\ \ln(x)+231 \quad (1)$$

$$C=1.26x^2-11.6x+63.4 \quad (2)$$

According to the aluminum alloy conductive wire of one or more embodiments, decrease in strength is sufficiently suppressed even after a heat-resistance test and hence it is possible to have excellent heat resistance.

In the above-mentioned aluminum alloy conductive wire, the tensile strength may be equal to or more than $T_2$ MPa represented by the following formula (3) in a case where the content rate of Mg in the aluminum alloy conductive wire is x mass %.

$$T_2=60.5\ \ln(x)+176 \quad (3)$$

In this case, when the aluminum alloy conductive wire is used in a portion which is subject to vibration, drawn or stored in a bent state, disconnection of the aluminum alloy conductive wire is sufficiently prevented.

In the above-mentioned aluminum alloy conductive wire, the content rate of Mg in the aluminum alloy conductive wire may be 1.45 mass % or less, the content rate of Si in the aluminum alloy conductive wire be 0.17 mass % or more and 0.25 mass % or less, and only Ti among Ti, V and B be contained in the aluminum alloy conductive wire.

In this case, when the aluminum alloy conductive wire has the same composition, it is possible to further improve heat resistance of the aluminum alloy conductive wire.

In addition, one or more embodiments are an electrical wire including the above-mentioned aluminum alloy conductive wire.

According to the electrical wire, since the aluminum alloy conductive wire can have excellent heat resistance, the electrical wire can have excellent heat resistance.

Further, one or more embodiments are a wire harness including a plurality of electrical wires described above.

According to the wire harness, since the electrical wire can have excellent heat resistance, the wire harness can have excellent heat resistance.

In addition, in one or more embodiments, the "tensile strength" refers to tensile strength measured by a tensile test carried out in accordance with JIS C3002.

Further, in one or more embodiments, the "conductivity" refers to conductivity determined from electrical resistance and mass measured in accordance with JIS C3002.

According to one or more embodiments, an aluminum alloy conductive wire having excellent heat resistance, an electrical wire and a wire harness using the same are provided.

DETAILED DESCRIPTION

Figure 1:
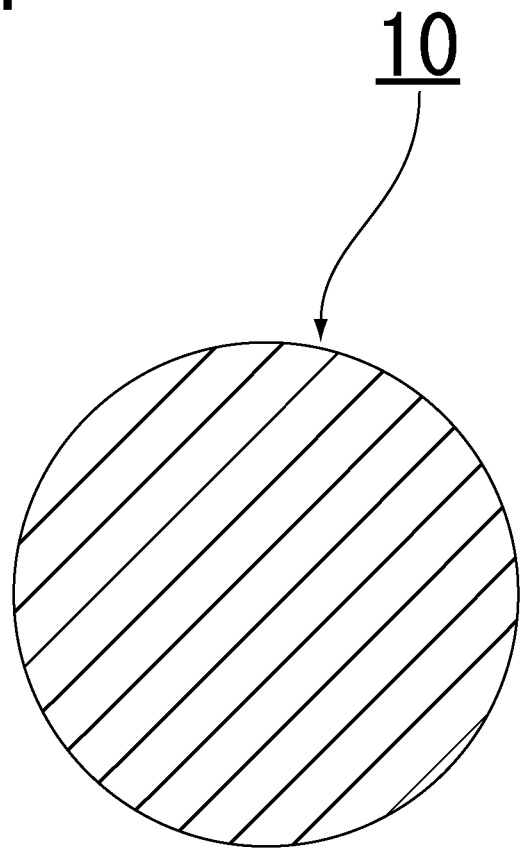
FIG. 1 is a cross-sectional view illustrating one or more embodiments of an aluminum alloy conductive wire.

Hereinafter, embodiments will be described with reference to FIG. 1. FIG. 1 is a cross-sectional view illustrating one or more embodiments of the aluminum alloy conductive wire.

<Aluminum Alloy Conductive Wire>

An aluminum alloy conductive wire 10 illustrated in FIG. 1 contains 0.15 mass % or more and 0.25 mass % or less of Si (silicon), 0.6 mass % or more and 0.9 mass % or less of Fe (iron), 0.05 mass % or more and 0.15 mass % or less of Cu (copper), 0.2 mass % or more and 2.7 mass % or less of Mg (magnesium), and 0.03 mass % or less in total of Ti (titanium), V (vanadium), and B (boron) and has tensile strength of equal to or less than $T_1$ MPa represented by the following formula (1) and has conductivity of equal to or more than C % IACS represented by the following formula (2), in a case where a content rate of Mg in the aluminum alloy conductive wire 10 is x mass %. Here, content rates of Si, Fe, Cu, and Mg and a total content rate of Ti, V, and B are based on the mass of the aluminum alloy conductive wire 10 (100 mass %).

$$T_1=59.5\ \ln(x)+231 \quad (1)$$

$$C=1.26x^2-11.6x+63.4 \quad (2)$$

The aluminum alloy conductive wire 10 contains 0.15 mass % or more and 0.25 mass % or less of Si. The content rate of Si is set to 0.15 mass % or more and 0.25 mass % or less since the aluminum alloy conductive wire 10 can balance tensile strength and elongation when compared to a case in which the content rate of Si is less than 0.15 mass %, and the aluminum alloy conductive wire 10 is excellent in conductivity when compared to a case in which the content rate of Si is more than 0.25 mass %. The content rate of Si may be 0.16 mass % or more and 0.22 mass % or less.

The aluminum alloy conductive wire 10 contains 0.6 mass % or more and 0.9 mass % or less of Fe. The content rate of Fe is set to 0.6 mass % or more and 0.9 mass % or less since the aluminum alloy conductive wire 10 can balance tensile strength and elongation when compared to a case in which the content rate of Fe is less than 0.6 mass %, and the aluminum alloy conductive wire 10 is excellent in conductivity when compared to a case in which the content rate of Fe is more than 0.9 mass %. The content rate of Fe may be 0.68 mass % or more and 0.82 mass % or less.

The aluminum alloy conductive wire 10 contains 0.05 mass % or more and 0.15 mass % or less of Cu. The content rate of Cu is set to 0.05 mass % or more and 0.15 mass % or less since the aluminum alloy conductive wire 10 can balance tensile strength and elongation when compared to a case in which the content rate of Cu is less than 0.05 mass %, and the aluminum alloy conductive wire 10 is excellent in conductivity when compared to a case in which the content rate of Cu is more than 0.15 mass %. The content rate of Cu may be 0.06 mass % or more and 0.12 mass % or less.

The aluminum alloy conductive wire 10 contains 0.2 mass % or more and 2.7 mass % or less of Mg. The content rate of Mg is set to 0.2 mass % or more and 2.7 mass % or less since the aluminum alloy conductive wire 10 can balance tensile strength and elongation when compared to a case in which the content rate of Mg is less than 0.2 mass %, and the aluminum alloy conductive wire 10 is more excellent in conductivity when compared to a case in which the content rate of Mg is more than 2.7 mass %. The content rate of Mg may be 0.2 mass % or more and 2.0 mass % or less.

In addition, in the aluminum alloy conductive wire 10, the total content rate of Ti, V, and B is 0.03 mass % or less. The total content rate of Ti, V, and B is set to 0.03 mass % or less since the aluminum alloy conductive wire 10 is more excellent in conductivity when compared to a case in which the total content rate of Ti, V, and B is set to be larger than 0.03 mass %. The total content rate of Ti, V, and B may be 0.01 mass % or less. In addition, the total content rate of Ti, V, and B may be 0.03 mass % or less and hence may be 0 mass %. Namely, all of Ti, V and B may be 0 mass %. Further, only Ti, only V or only B among Ti, V and B may be 0 mass %, respectively.

In the aluminum alloy conductive wire 10, the content rate of Mg in the aluminum alloy conductive wire 10 may be 1.45 mass % or less, the content rate of Si in the aluminum alloy conductive wire 10 be 0.17 mass % or more and 0.25 mass % or less, and only Ti among Ti, V and B be contained in the aluminum alloy conductive wire 10.

In this case, when the aluminum alloy conductive wire 10 has the same composition, namely, when the content rates of Si, Fe, Cu, Mg and Ti in the aluminum alloy conductive wire 10 are identical to each other, it is possible to further improve heat resistance of the aluminum alloy conductive wire 10.

Here, the content rate of Mg in the aluminum alloy conductive wire 10 may be 0.3 mass % or more. In this case, it is possible to further improve heat resistance compared to a case where the content rate of Mg in the aluminum alloy conductive wire 10 is less than 0.3 mass %.

Further, the content rate of Si in the aluminum alloy conductive wire 10 may be 0.23 mass % or less. In this case, it is possible to further improve heat resistance compared to a case where the content rate of Si in the aluminum alloy conductive wire 10 exceeds 0.23 mass %.

In addition, in the aluminum alloy conductive wire 10, tensile strength is equal to or less than $T_1$ MPa represented by the following formula (1) in a case where a content rate of Mg in the aluminum alloy conductive wire 10 is x mass %. In this case, more excellent heat resistance is obtained compared to a case tensile strength of the aluminum alloy conductive wire 10 exceeds $T_1$ MPa represented by the above formula (1).

In the aluminum alloy conductive wire 10, tensile strength is equal to or more than $T_2$ MPa represented by the following formula (3) in a case where a content rate of Mg in the aluminum alloy conductive wire 10 is x mass %. In this case, disconnection of the aluminum alloy conductive wire 10 is sufficiently prevented when the aluminum alloy conductive wire 10 is used in a portion which is subject to vibration, drawn or stored in a bent state, compared to a case in which tensile strength is less than $T_2$ MPa represented by the following formula (3) in the aluminum alloy conductive wire 10.

$$T_2=60.5\ \ln(x)+176 \quad (3)$$

Furthermore, in the aluminum alloy conductive wire 10, conductivity is equal to or more than C % IACS represented by the above formula (2). In this case, in the aluminum alloy conductive wire 10, more excellent heat resistance is obtained compared to a case where conductivity is less than C % IACS represented by the above formula (2). However, conductivity of the aluminum alloy conductive wire 10 may be 65% IACS or less.

Next, a method of manufacturing the aluminum alloy conductive wire 10 will be described.

The aluminum alloy conductive wire 10 can be obtained by a manufacturing method including a rough drawing wire formation step of forming a rough drawing wire made of an aluminum alloy containing 0.15 mass % or more and 0.25 mass % or less of Si, 0.6 mass % or more and 0.9 mass % or less of Fe, 0.05 mass % or more and 0.15 mass % or less of Cu, 0.2 mass % or more and 2.7 mass % or less of Mg, and 0.03 mass % or less in total of Ti, V, and B, and a processing step of obtaining the aluminum alloy conductive wire 10 by performing a processing process including a heat treatment process and a wire drawing process on the rough drawing wire.

Next, the rough drawing wire formation step and the processing step mentioned above will be described in detail.

<Rough Drawing Wire Formation Step>

The rough drawing wire formation step is a process of forming the rough drawing wire made of the above-mentioned aluminum alloy.

For example, the rough drawing wire mentioned above can be obtained by performing continuous casting and rolling, hot extrusion after billet casting or the like on molten metal made of the above-mentioned aluminum alloy.

<Processing Step>

The processing step is a step of obtaining the aluminum alloy conductive wire 10 by performing the above-mentioned processing process on the rough drawing wire.

(Processing Process)

The processing process is a process including the wire drawing process and the heat treatment process.

The processing process may include the wire drawing process and the heat treatment process. Examples of a specific aspect of a procedure of the processing process include aspects below.

heat treatment process→wire drawing process→heat treatment process heat treatment process→wire drawing process→heat treatment process→wire drawing process→heat treatment process heat treatment process→wire drawing process→heat treatment process→wire drawing process→heat treatment process→wire drawing process→heat treatment process wire drawing process→heat treatment process wire drawing process→heat treatment process→wire drawing process→heat treatment process wire drawing process→heat treatment process→wire drawing process→heat treatment process→wire drawing process→heat treatment process However, the procedure of the processing process is not limited to the above aspects. For example, the wire drawing process may be further performed in each of the above specific aspects. In this case, the heat treatment process needs to be performed after the wire drawing process.

The wire drawing process is a process of reducing a diameter of the rough drawing wire, a drawn wire material obtained by drawing the rough drawing wire, a drawn wire material obtained by further drawing the drawn wire material (hereinafter the "rough drawing wire", the "drawn wire material obtained by drawing the rough drawing wire", and the "drawn wire material obtained by further drawing the drawn wire material" will be referred to as "wire materials") or the like. The wire drawing process may be a hot wire drawing or cold wire drawing, and normally be cold wire drawing.

In addition, when a diameter of the wire material subjected to the wire drawing process is large (for example, 3 mm or more), heat treatment may be performed from the middle to remove distortion generated by wire drawing in the wire drawing process.

The heat treatment process is a process of performing heat treatment on the wire material. In particular, the heat treatment process performed after the wire drawing process is performed to remove distortion generated in the wire material in the wire drawing process.

To set the tensile strength to equal to or less than $T_1$ MPa represented by the above-mentioned formula (1), and set the conductivity to equal to or more than C % IACS represented by the above-mentioned formula (2), a heat treatment temperature in the heat treatment process may normally be set to 200° C. or more and 400° C. or less, and a heat treatment time in the heat treatment process may normally be set to 1 minute to 24 hours.

In particular, in a heat treatment process finally performed in the heat treatment process (hereinafter referred to as a "final heat treatment process"), heat treatment may be performed on the wire material at 350° C. or less. In this case, the aluminum alloy conductive wire 10 can have high conductivity. However, a heat treatment temperature of the wire material in the final heat treatment process may be 200° C. or more since strength is more sufficiently lowered.

A heat treatment time in the final heat treatment process may be 1 hour or more. In this case, a more uniform wire material is obtained over the entire length when compared to a case in which the heat treatment of the drawn wire material is performed for less than 1 hour. However, the heat treatment time may be 12 hours or less.

(Electrical Wire)

Figure 2:
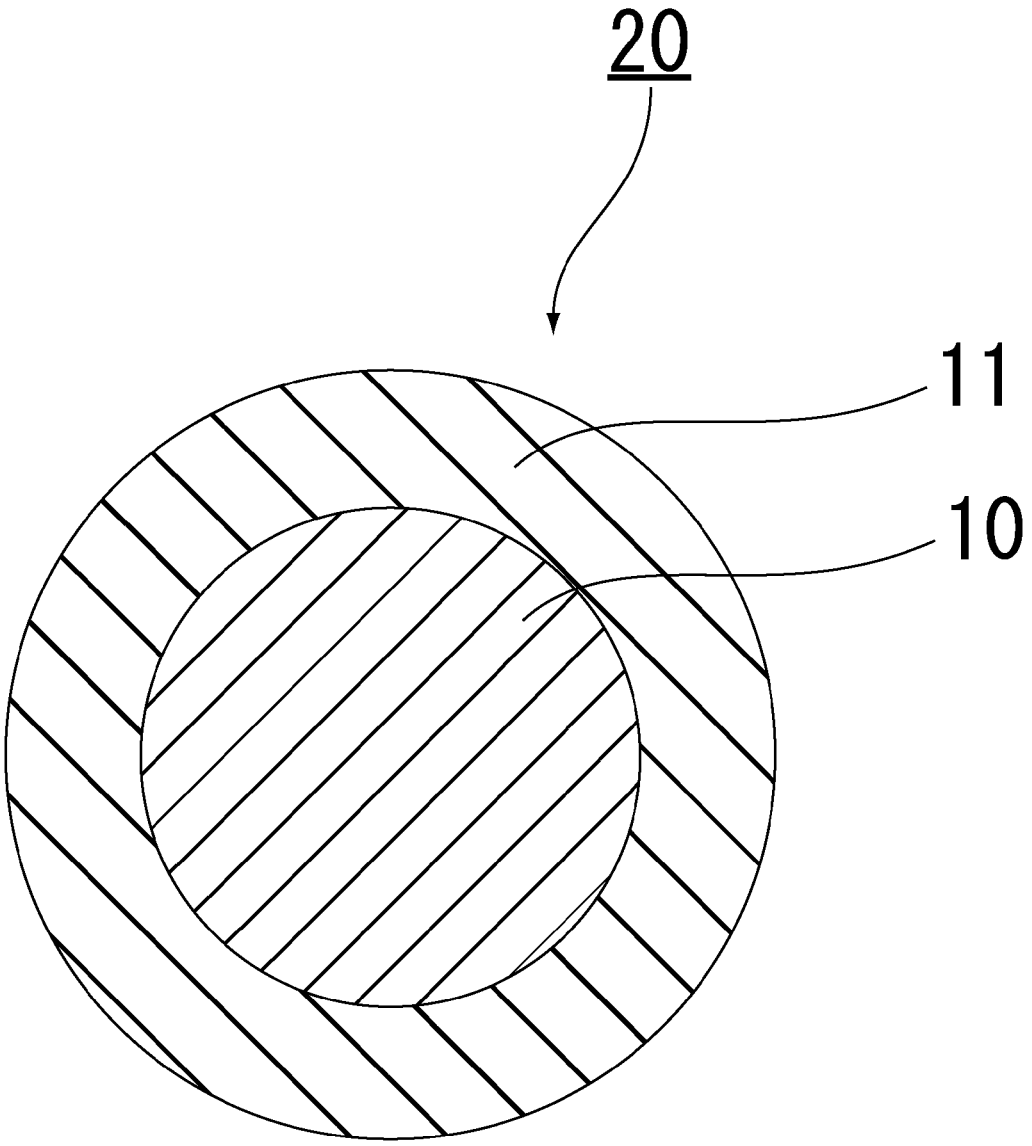
FIG. 2 is a cross-sectional view illustrating one or more embodiments of an electrical wire.

Next, the electrical wire of one or more embodiments will be described with reference to FIG. 2. FIG. 2 is a cross-sectional view illustrating one or more embodiments of the electrical wire.

As illustrated in FIG. 2, the electrical wire 20 includes the above-described aluminum alloy conductive wire 10.

According to the electrical wire 20, since the aluminum alloy conductive wire 10 can have excellent heat resistance, the electrical wire can have excellent heat resistance.

Typically, the electrical wire 20 further includes a covering layer 11 that covers the above-mentioned aluminum alloy conductive wire 10. For example, the covering layer 11 is made of a polyvinyl chloride resin or a flame retardant resin composition obtained by adding a flame retardant or the like to a polyolefin resin.

(Wire Harness)

Figure 3:
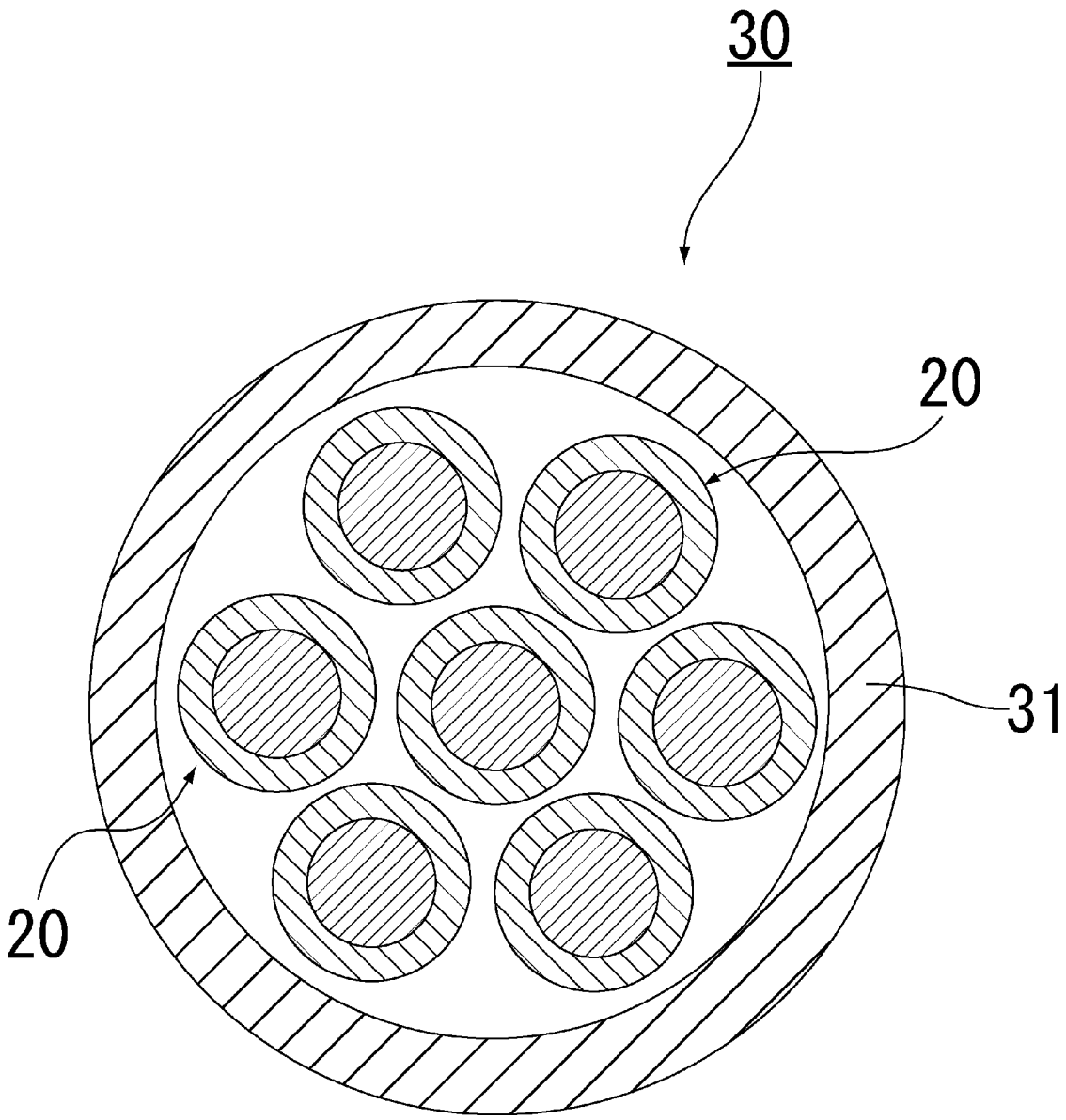
FIG. 3 is a cross-sectional view illustrating one or more embodiments of a wire harness.

Next, the wire harness of one or more embodiments will be described with reference to FIG. 3. FIG. 3 is a cross-sectional view illustrating one or more embodiments of the wire harness A wire harness 30 includes a plurality of electrical wires 20.

Since the electrical wire 20 can have excellent heat resistance, the wire harness 30 can have excellent heat resistance.

EXAMPLES

Hereinafter, the content of one or more embodiments will be described more specifically using examples and comparative examples. However, one or more embodiments are not limited to the following examples.

Examples 1 to 20 and Comparative Examples 1 to 20

An aluminum alloy having a wire diameter of 25 mm was cast by dissolving Si, Fe, Cu, Mg, Ti, V and B together with aluminum such that content rates shown in Table 1 and 2 are obtained, and then pouring into a mold having a diameter of 25 mm. Then, a rough drawing wire having a wire diameter of 9.5 mm was obtained by performing a swaging processing on thus obtained aluminum alloy with a swaging machine (manufactured by Yoshida Kinen Co., Ltd.) such that a diameter of 9.5 mm was obtained and then performing a heat treatment at 270° C. for 8 hours. An aluminum alloy conductive wire was obtained by processing thus obtained rough drawing wire using the following processing method.

(Processing Method)

wire drawing up to wire diameter of 3.1 mm→heat treatment at 270° C. for 8 hours→wire drawing up to wire diameter of 1.25 mm→heat treatment at 270° C. for 8 hours→wire drawing up to wire diameter of 0.33 mm→heat treatment at temperature and for time of final heat treatment shown in Tables 1 and 2

In addition, a tensile test in accordance with JIS C3002 was carried out on the aluminum alloy conductive wires obtained as described above to measure tensile strengths. Results are shown in Tables 1 and 2. In addition, $T_1$ represented by the following formula (1) and $T_2$ represented by the following formula (3) were also shown together with tensile strengths in Tables 1 and 2. Further, in Tables 1 and 2, unit of tensile strength is MPa.

$$T_1=59.5\ \ln(x)+231 \quad (1)$$

$$T_2=60.5\ \ln(x)+176 \quad (3)$$

(In the above formula (1) and (3), x denotes the content rate of Mg in the aluminum alloy conductive wire)

In addition, mass and electrical resistance were measured in accordance with JIS C3002 on the aluminum alloy conductive wires obtained as described above and then conductivities were determined based on the measured mass and electrical resistance. Results are shown in Tables 1 and 2. In addition, C represented by the following formula (2) was also shown together with conductivities in Tables 1 and 2. Further, in Tables 1 and 2, unit of conductivity is % IACS.

$$C=1.26x^2-11.6x+63.4 \quad (2)$$

(In the above formula (2), x denotes the content rate of Mg in the aluminum alloy conductive wire)

(Heat Resistance)

A heat-resistance test was carried out on the aluminum alloy conductive wires of Examples 1 to 20 and Comparative Examples 1 to 20 obtained as described above. The heat-resistance test was carried out by holding the aluminum alloy conductive wires at 150° C. for 1,000 hours. Then, the tensile test in accordance with JIS C3002 was carried out on the aluminum alloy conductive wires after the heat-resistance test to measure tensile strengths. Then, a residual rate of tensile strength after the heat-resistance test to tensile strength before the heat-resistance test was calculated based on the tensile strengths before and after the heat-resistance test and an equation below. Results are shown in Tables 1 and 2.

Residual rate (%)=100×tensile strength after heat-resistance test/tensile strength before heat-resistance test In addition, in Tables 1 and 2, an aluminum alloy conductive wire in which the residual rate is 95% or more was regarded as having excellent heat resistance, passed, and marked with "○". In addition, an aluminum alloy conductive wire in which the residual rate is less than 95% was regarded as being inferior in heat resistance, rejected, and marked with "×" in Tables 1 and 2.

TABLE 1

| | Content rate (mass %) of added element | | | | | | | | Final heat treatment | |
|---|---|---|---|---|---|---|---|---|---|---|
| | Si | Fe | Cu | Mg | Ti | V | B | Ti + V + B | Temperature (° C.) | Time (h) |
| Example 1 | 0.21 | 0.68 | 0.07 | 0.30 | 0.006 | 0 | 0 | 0.006 | 220 | 8 |
| Example 2 | 0.21 | 0.68 | 0.07 | 0.30 | 0.006 | 0 | 0 | 0.006 | 270 | 8 |
| Example 3 | 0.17 | 0.77 | 0.11 | 0.46 | 0.01 | 0 | 0 | 0.01 | 220 | 8 |
| Example 4 | 0.17 | 0.77 | 0.11 | 0.46 | 0.01 | 0 | 0 | 0.01 | 270 | 8 |
| Example 5 | 0.16 | 0.73 | 0.10 | 0.52 | 0.016 | 0 | 0 | 0.016 | 220 | 8 |
| Example 6 | 0.16 | 0.73 | 0.10 | 0.52 | 0.016 | 0 | 0 | 0.016 | 270 | 8 |
| Example 7 | 0.23 | 0.83 | 0.14 | 0.96 | 0.003 | 0 | 0 | 0.003 | 220 | 8 |
| Example 8 | 0.23 | 0.83 | 0.14 | 0.96 | 0.003 | 0 | 0 | 0.003 | 270 | 8 |
| Example 9 | 0.20 | 0.66 | 0.08 | 1.43 | 0.02 | 0 | 0 | 0.02 | 220 | 8 |
| Example 10 | 0.20 | 0.66 | 0.08 | 1.43 | 0.02 | 0 | 0 | 0.02 | 270 | 8 |
| Example 11 | 0.24 | 0.84 | 0.05 | 1.88 | 0.011 | 0 | 0 | 0.011 | 220 | 8 |
| Example 12 | 0.24 | 0.84 | 0.05 | 1.88 | 0.011 | 0 | 0 | 0.011 | 270 | 8 |
| Example 13 | 0.17 | 0.79 | 0.11 | 2.56 | 0.009 | 0 | 0 | 0.009 | 220 | 8 |
| Example 14 | 0.17 | 0.79 | 0.11 | 2.56 | 0.009 | 0 | 0 | 0.009 | 270 | 8 |
| Example 15 | 0.20 | 0.75 | 0.09 | 0.54 | 0.008 | 0.005 | 0 | 0.013 | 220 | 8 |
| Example 16 | 0.20 | 0.75 | 0.09 | 0.54 | 0.008 | 0.005 | 0 | 0.013 | 270 | 8 |
| Example 17 | 0.22 | 0.69 | 0.06 | 0.58 | 0.006 | 0 | 0.002 | 0.008 | 220 | 8 |
| Example 18 | 0.22 | 0.69 | 0.06 | 0.58 | 0.006 | 0 | 0.002 | 0.008 | 270 | 8 |
| Example 19 | 0.17 | 0.81 | 0.09 | 0.53 | 0 | 0 | 0 | 0 | 220 | 8 |
| Example 20 | 0.17 | 0.81 | 0.09 | 0.53 | 0 | 0 | 0 | 0 | 270 | 8 |

| | After final heat treatment | | | | | After heat-resistance test | | |
|---|---|---|---|---|---|---|---|---|
| | $T_1$ | $T_2$ | Tensile strength (MPa) | C | Conductivity (% IACS) | Tensile strength (MPa) | Residual rate (%) | Determination |
| Example 1 | 159.4 | 103.2 | 124.8 | 60.03 | 61.0 | 124.1 | 99.4 | ○ |
| Example 2 | 159.4 | 103.2 | 116.1 | 60.03 | 60.5 | 113.2 | 97.5 | ○ |
| Example 3 | 184.8 | 129.0 | 149.4 | 58.33 | 59.2 | 150.4 | 100.7 | ○ |
| Example 4 | 184.8 | 129.0 | 134.4 | 58.33 | 59.3 | 135.7 | 101.0 | ○ |
| Example 5 | 192.1 | 136.4 | 162.2 | 57.71 | 58.1 | 159.6 | 98.4 | ○ |
| Example 6 | 192.1 | 136.4 | 144.8 | 57.71 | 58.5 | 142.8 | 98.6 | ○ |
| Example 7 | 228.6 | 173.5 | 204.7 | 53.43 | 53.6 | 203.2 | 99.3 | ○ |
| Example 8 | 228.6 | 173.5 | 182.8 | 53.43 | 53.8 | 182.0 | 99.6 | ○ |
| Example 9 | 252.3 | 197.6 | 223.9 | 49.39 | 50.1 | 224.7 | 100.4 | ○ |
| Example 10 | 252.3 | 197.6 | 203.5 | 49.39 | 50.3 | 205.5 | 101.0 | ○ |
| Example 11 | 268.6 | 214.2 | 240.8 | 46.05 | 46.6 | 238.5 | 99.0 | ○ |
| Example 12 | 268.6 | 214.2 | 223.1 | 46.05 | 46.7 | 221.5 | 99.3 | ○ |
| Example 13 | 286.9 | 232.9 | 260.9 | 41.96 | 42.4 | 257.5 | 98.7 | ○ |

TABLE 1-continued

| | | | | | | | | |
|---|---|---|---|---|---|---|---|---|
| Example 14 | 286.9 | 232.9 | 243.3 | 41.96 | 42.5 | 243.5 | 100.1 | ○ |
| Example 15 | 194.3 | 138.7 | 165.1 | 57.50 | 57.9 | 162.2 | 98.2 | ○ |
| Example 16 | 194.3 | 138.7 | 146.9 | 57.50 | 58.3 | 145.1 | 98.8 | ○ |
| Example 17 | 198.6 | 143.0 | 170.2 | 57.10 | 57.5 | 167.3 | 98.3 | ○ |
| Example 18 | 198.6 | 143.0 | 151.0 | 57.10 | 57.8 | 148.0 | 98.0 | ○ |
| Example 19 | 193.2 | 137.6 | 162.4 | 57.61 | 58.2 | 157.9 | 97.2 | ○ |
| Example 20 | 193.2 | 137.6 | 145.0 | 57.61 | 58.5 | 141.5 | 97.6 | ○ |

TABLE 2

| | Content rate (mass %) of added element | | | | | | | | Final heat treatment | |
|---|---|---|---|---|---|---|---|---|---|---|
| | Si | Fe | Cu | Mg | Ti | V | B | Ti + V + B | Temperature (° C.) | Time (h) |
| Comprative Example 1 | 0.21 | 0.68 | 0.07 | 0.30 | 0.006 | 0 | 0 | 0.006 | 180 | 8 |
| Comprative Example 2 | 0.21 | 0.68 | 0.07 | 0.30 | 0.006 | 0 | 0 | 0.006 | 450 | 3 |
| Comprative Example 3 | 0.17 | 0.77 | 0.11 | 0.46 | 0.01 | 0 | 0 | 0.01 | 180 | 8 |
| Comprative Example 4 | 0.17 | 0.77 | 0.11 | 0.46 | 0.01 | 0 | 0 | 0.01 | 450 | 0.17 |
| Comprative Example 5 | 0.16 | 0.73 | 0.10 | 0.52 | 0.016 | 0 | 0 | 0.016 | 180 | 8 |
| Comprative Example 6 | 0.16 | 0.73 | 0.10 | 0.52 | 0.016 | 0 | 0 | 0.016 | 450 | 3 |
| Comprative Example 7 | 0.23 | 0.83 | 0.14 | 0.96 | 0.003 | 0 | 0 | 0.003 | 180 | 8 |
| Comprative Example 8 | 0.23 | 0.83 | 0.14 | 0.96 | 0.003 | 0 | 0 | 0.003 | 450 | 0.17 |
| Comprative Example 9 | 0.20 | 0.66 | 0.08 | 1.43 | 0.02 | 0 | 0 | 0.02 | 180 | 8 |
| Comprative Example 10 | 0.20 | 0.66 | 0.08 | 1.43 | 0.02 | 0 | 0 | 0.02 | 550 | 0.17 |
| Comprative Example 11 | 0.24 | 0.84 | 0.05 | 1.88 | 0.011 | 0 | 0 | 0.011 | 180 | 8 |
| Comprative Example 12 | 0.24 | 0.84 | 0.05 | 1.88 | 0.011 | 0 | 0 | 0.011 | 550 | 0.17 |
| Comprative Example 13 | 0.17 | 0.79 | 0.11 | 2.56 | 0.009 | 0 | 0 | 0.009 | 180 | 8 |
| Comprative Example 14 | 0.17 | 0.79 | 0.11 | 2.56 | 0.009 | 0 | 0 | 0.009 | 550 | 0.17 |
| Comprative Example 15 | 0.20 | 0.75 | 0.09 | 0.54 | 0.008 | 0.005 | 0 | 0.013 | 180 | 8 |
| Comprative Example 16 | 0.20 | 0.75 | 0.09 | 0.54 | 0.008 | 0.005 | 0 | 0.013 | 450 | 3 |
| Comprative Example 17 | 0.22 | 0.69 | 0.06 | 0.58 | 0.006 | 0 | 0.002 | 0.008 | 180 | 8 |
| Comprative Example 18 | 0.22 | 0.69 | 0.06 | 0.58 | 0.006 | 0 | 0.002 | 0.008 | 450 | 3 |
| Comprative Example 19 | 0.17 | 0.81 | 0.09 | 0.53 | 0 | 0 | 0 | 0 | 180 | 8 |
| Comprative Example 20 | 0.17 | 0.81 | 0.09 | 0.53 | 0 | 0 | 0 | 0 | 450 | 3 |

| | After final heat treatment | | | | | After heat-resistance test | | |
|---|---|---|---|---|---|---|---|---|
| | $T_1$ | $T_2$ | Tensile strength (MPa) | C | Conductivity (% IACS) | Tensile strength (MPa) | Residual rate (%) | Determination |
| Comprative Example 1 | 159.4 | 103.2 | 164.6 | 60.03 | 60.7 | 143.3 | 87.1 | x |
| Comprative Example 2 | 159.4 | 103.2 | 123.8 | 60.03 | 58.6 | 117.0 | 94.5 | x |
| Comprative Example 3 | 184.8 | 129.0 | 191.4 | 58.33 | 58.9 | 173.5 | 90.6 | x |
| Comprative Example 4 | 184.8 | 129.0 | 153.6 | 58.33 | 54.8 | 143.3 | 93.3 | x |
| Comprative Example 5 | 192.1 | 136.4 | 203.4 | 57.71 | 57.9 | 184.1 | 90.5 | x |
| Comprative Example 6 | 192.1 | 136.4 | 156.2 | 57.71 | 54.5 | 147.4 | 94.4 | x |
| Comprative Example 7 | 228.6 | 173.5 | 252.4 | 53.43 | 53.5 | 224.7 | 89.0 | x |

TABLE 2-continued

| | | | | | | | | |
|---|---|---|---|---|---|---|---|---|
| Comprative Example 8 | 228.6 | 173.5 | 174.0 | 53.43 | 52.6 | 165.1 | 94.9 | x |
| Comprative Example 9 | 252.3 | 197.6 | 272.3 | 49.39 | 49.7 | 244.6 | 89.8 | x |
| Comprative Example 10 | 252.3 | 197.6 | 202.0 | 49.39 | 45.4 | 190.6 | 94.4 | x |
| Comprative Example 11 | 268.6 | 214.2 | 278.6 | 46.05 | 46.3 | 259.8 | 93.3 | x |
| Comprative Example 12 | 268.6 | 214.2 | 218.0 | 46.05 | 43.4 | 205.1 | 94.1 | x |
| Comprative Example 13 | 286.9 | 232.9 | 293.1 | 41.96 | 42.1 | 273.5 | 93.3 | x |
| Comprative Example 14 | 286.9 | 232.9 | 237.0 | 41.96 | 40.9 | 222.2 | 93.8 | x |
| Comprative Example 15 | 194.3 | 138.7 | 205.0 | 57.50 | 57.8 | 183.8 | 89.7 | x |
| Comprative Example 16 | 194.3 | 138.7 | 158.9 | 57.50 | 54.2 | 150.2 | 94.5 | x |
| Comprative Example 17 | 198.6 | 143.0 | 209.9 | 57.10 | 57.3 | 192.6 | 91.8 | x |
| Comprative Example 18 | 198.6 | 143.0 | 163.3 | 57.10 | 54.0 | 154.2 | 94.4 | x |
| Comprative Example 19 | 193.2 | 137.6 | 203.3 | 57.61 | 57.9 | 181.9 | 89.5 | x |
| Comprative Example 20 | 193.2 | 137.6 | 157.6 | 57.61 | 54.5 | 147.9 | 93.8 | x |

From the results shown in Table 1, it was found that all of the aluminum alloy conductive wires of Examples 1 to 20 have the residual rate of 95% or more and satisfy a pass criterion in terms of heat resistance. On the other hand, from the results shown in Table 2, it was found that all of the aluminum alloy conductive wires of Comparative Examples 1 to 20 have the residual rate of less than 95% and do not satisfy the pass criterion in terms of heat resistance.

From the above description, it was confirmed that the aluminum alloy conductive wire of one or more embodiments has excellent heat resistance.

EXPLANATIONS OF REFERRENCE NUMERALS

10 . . . aluminum alloy conductive wire
20 . . . electrical wire
30 . . . wire harness Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

The invention claimed is:

1. An aluminum alloy conductive wire, comprising:
0.15 mass % or more and 0.25 mass % or less of Si,
0.60 mass % or more and 0.90 mass % or less of Fe,
0.05 mass % or more and 0.15 mass % or less of Cu,
0.46 mass % or more and 2.70 mass % or less of Mg, and
0.03 mass % or less in total of Ti, V, and B,
wherein the aluminum alloy conductive wire has tensile strength of equal to or less than Ti MPa represented by formula (1) below and conductivity of equal to or more than C % IACS represented by formula (2) below in a case where a content rate of Mg in the aluminum alloy conductive wire is x mass %, $$T_1=59.5\ \ln(x)+231 \quad (1)$$

$$C=1.26x^2-11.6x+63.4 \quad (2),$$

wherein a content of Ti is less than 0.001 mass %, and
wherein the tensile strength is equal to or more than $T_2$ MPa represented by formula (3) below in a case where the content rate of Mg in the aluminum alloy conductive wire is x mass %, $$T_2=60.5\ \ln(x)+176 \quad (3).$$

2. The aluminum alloy conductive wire according to claim 1, wherein the content rate of Mg in the aluminum alloy conductive wire is 0.46 mass % or more and 1.45 mass % or less,
a content rate of Si in the aluminum alloy conductive wire is 0.17 mass % or more and 0.25 mass % or less, and
only Ti among Ti, V, and B is contained in the aluminum alloy conductive wire.

3. An electrical wire, comprising the aluminum alloy conductive wire according to claim 1.

4. A wire harness, comprising a plurality of electrical wires according to claim 3.

5. The aluminum alloy conductive wire according to claim 1, wherein a content rate of Fe in the aluminum alloy conductive wire is 0.68 mass % or more and 0.82 mass % or less.

6. The aluminum alloy conductive wire according to claim 1, wherein a content rate of Cu in the aluminum alloy conductive wire is 0.06 mass % or more and 0.12 mass % or less.

7. The aluminum alloy conductive wire according to claim 1, wherein the content rate of Mg in the aluminum alloy conductive wire is 0.46 mass % or more and 2.00 mass % or less.

8. The aluminum alloy conductive wire according to claim 1, wherein a total content rate of Ti, V, and B in the aluminum alloy conductive wire is 0.01 mass % or less.

* * * * *